United States Patent [19]

Jimenez

[11] Patent Number: 4,472,147

[45] Date of Patent: Sep. 18, 1984

[54] FIN-POLE SWIM APPARATUS

[76] Inventor: Cecilio V. Jimenez, 4326 Hermosa Dr., Corpus Christi, Tex. 78441

[21] Appl. No.: 448,610

[22] Filed: Jan. 31, 1983

[51] Int. Cl.[3] ..... B63H 16/08

[52] U.S. Cl. ..... 440/17; 440/21; 440/25

[58] Field of Search ..... 441/55; 440/21, 25, 440/32, 13, 17, 19, 20, 24

[56] References Cited

U.S. PATENT DOCUMENTS

| | | | |
|---|---|---|---|
| 1,587,605 | 6/1926 | Scroggins | 440/17 X |
| 2,026,888 | 1/1936 | Granger | 440/19 |
| 2,918,891 | 12/1959 | Klabunde | 440/17 |

*Primary Examiner*—Sherman D. Basinger

[57] ABSTRACT

This device is for aiding a swimmer to obtain more thrust when swimming underwater. Primarily, it consists of a pair of poles secured to a harness, which is worn by the user. It also consists of a plurality of pivotal fins secured to the harness, for increasing the speed of the user, who moves the device by a pair of handle grips secured to the poles.

1 Claim, 6 Drawing Figures

FIN-POLE SWIM APPARATUS

This invention relates to underwater propelling devices for swimmers, and more particularly, to a fin pole apparatus.

The principal object of this invention is to provide a fin-pole swim apparatus, which will be adaptable for use by scuba divers to cover greater distances, as are necessary by the Navy's underwater demolition personnel.

Another object of this invention is to provide a fin-pole swim apparatus, which will employ fin-like appendages attached to it, so as to aid a person when swimming underwater.

A further object of this invention is to provide a fin-pole swim apparatus, which will be so designed, that the fins will close inward when the pole is pulled forward, thus offering little water resistance, and when the device is pulled backwards, the water will open the fins, which offer resistance and thereby will thrust the user forward in the water.

Other objects are to provide a fin-pole swim apparatus, which is simple in design, inexpensive to manufacture, rugged in construction, easy to use, and efficient in operation.

These, and other objects, will be readily evident, upon a study of the following specification, and the accompanying drawing, wherein.

Figure 1:
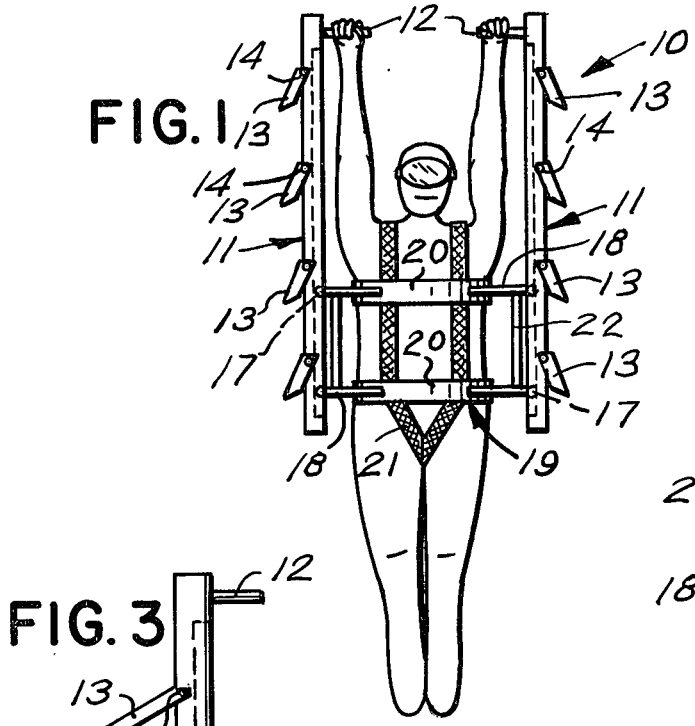
FIG. 1 is a front view of the present invention, shown attached to the user.
Figure 2:
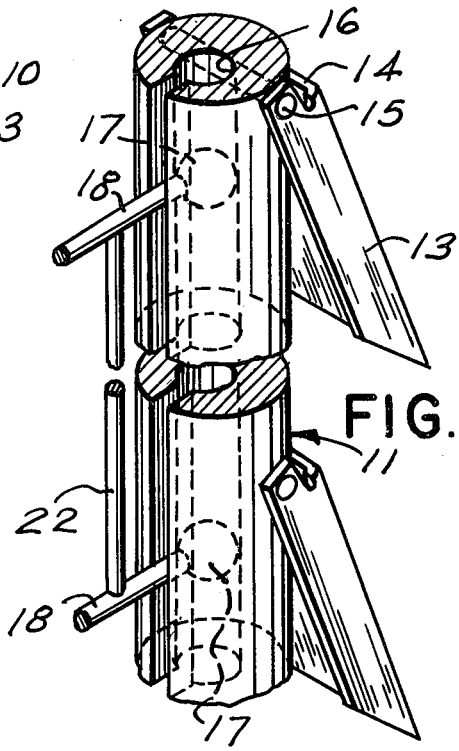
FIG. 2 is an enlarged fragmentary front elevational view of FIG. 1, showing portions in section.
Figure 3:
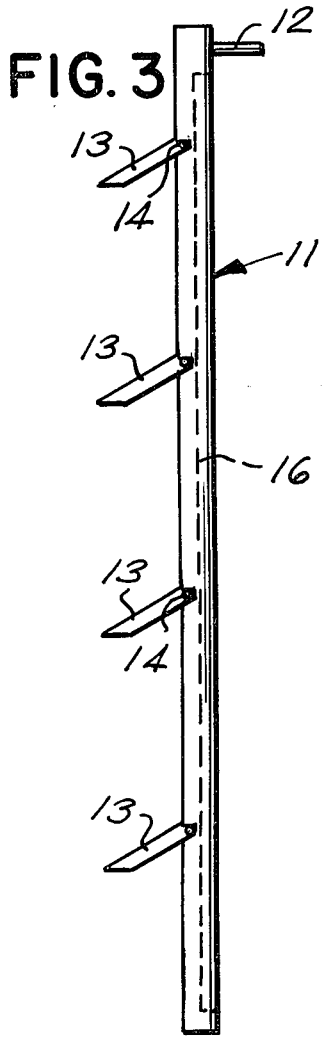
FIG. 3 is an enlarged view of the left portion of FIG. 1, shown in elevation, and illustrating the harness removed therefrom.
Figure 4:
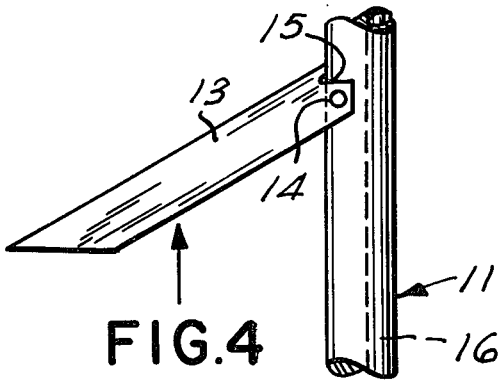
FIG. 4 is a fragmentary and further enlarged view of FIG. 3.
Figure 5:
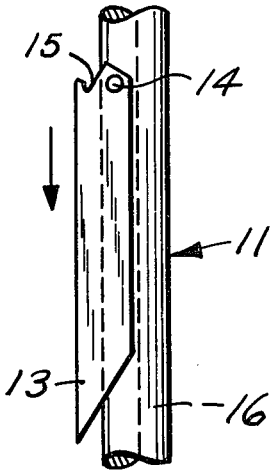
FIG. 5 is similar to FIG. 4, but illustrates the fin in closed position.
Figure 6:
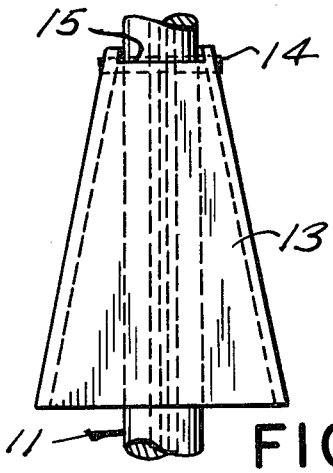
FIG. 6 is a left side view of FIG. 5.

According to this invention, an apparatus 10 is shown to include a pair of poles 11, each having a handle 12 fixedly secured to their forward end portions in a suitable manner (not shown). A plurality of equally spaced fins 13 are of "U"-shaped cross-sectional configuration, and are pivotally secured to poles 11 by pins 14, which are off-set from the longitudinal axis of each pole 11, and a groove 15 in the pivotal area of fins 13 enables fins

13 to pivot outwards when apparatus 10 is in use. A keyhole-shaped slot 16 extends almost from end to end in poles 11, and receives the ball portions 17 of rods 18, which are secured to a harness 19. The ball portions 17 are freely received in slots 16, and the opposite ends of rods 18 are fixedly secured to the harness belts 20, which are secured to straps 21, which embrace the legs and shoulders of the user. The rods 18 are further secured to cross-bars 22, so as to move simultaneously.

In use, the apparatus 10 is strapped to the user by the harness 19, and, when in the water, the user grips the handles 12. When the user pulls the poles 11 forward, the force of the water causes the fins 13 to close against the poles 11 by the pins 14, and offer little water resistance. When the user pulls the poles 11 backwards, the water will open or pivot the fins 13 outwards, which will offer resistance to the water, and thrust the user forward.

While various changes may be made in the detail construction, it is understood that such changes will be within the spirit and scope of the present invention, as is defined by the appended claims.

What I claim is:

1. A fin-pole swim apparatus, comprising, in combination, a pair of poles, a sideward handle affixed on a forward end portion of each said pole, a row of equally spaced-apart fins of "U"-shaped cross-sectional configuration being pivotally secured along a side of each said pole, each said fin being pivoted on a pin extending transversely through each said pole, each said pin being off-set from a longitudinal central axis of each said pole, a groove in a pivotal area of each said fin enabling said fin to pivot outwardly, a keyhole-shaped slot extending almost end to end on each said pole, and a harness for a swimmer being located between said poles and supported in said keyhole-shaped slots; said harness comprising a pair of spaced-apart harness belts for extending around the body of said swimmer, a plurality of straps being each secured to both said harness belts and including means to embrace the legs and shoulders of said swimmer, a pair of rods secured at their one ends to each said harness belt, a ball portion formed on an opposite end of each said rod, said ball portions being freely received in said keyhole-shaped slots, and a cross-bar secured between each pair of rods that extend from the same said keyhole-shaped slot.

* * * * *